US010633150B2

(12) United States Patent
Webber et al.

(10) Patent No.: US 10,633,150 B2
(45) Date of Patent: Apr. 28, 2020

(54) POUR SPOUT DEVICE

(71) Applicants: Daniel Robert Webber, Cincinnati, OH (US); Michael Scott Goldstein, Cincinnati, OH (US)

(72) Inventors: Daniel Robert Webber, Cincinnati, OH (US); Michael Scott Goldstein, Cincinnati, OH (US)

(73) Assignee: Bucktap LLC, Amelia, OH (US)

( * ) Notice: Subject to any disclaimer, the term of this patent is extended or adjusted under 35 U.S.C. 154(b) by 0 days.

(21) Appl. No.: 16/208,747

(22) Filed: Dec. 4, 2018

(65) Prior Publication Data

US 2019/0168928 A1 Jun. 6, 2019

Related U.S. Application Data

(60) Provisional application No. 62/594,204, filed on Dec. 4, 2017.

(51) Int. Cl.
*B65D 47/06* (2006.01)
*B65D 25/40* (2006.01)
(Continued)

(52) U.S. Cl.
CPC ..... *B65D 47/06* (2013.01); *B65D 25/40* (2013.01); *A47G 19/2266* (2013.01); *B65D 43/0214* (2013.01)

(58) Field of Classification Search
CPC .... B65D 47/06; B65D 25/40; B65D 43/0214; A47G 19/2266
(Continued)

(56) References Cited

U.S. PATENT DOCUMENTS 1,472,398 A * 10/1923 Longman ..... B65D 41/0442 215/337
1,494,043 A 5/1924 Vogt
(Continued)

FOREIGN PATENT DOCUMENTS

WO 03066463 8/2003

OTHER PUBLICATIONS

"First Sip: Bootleggers Inn Opens on Lower Broad", Nashville Scene, dated Oct. 26, 2011, https://www.nashvillescene.com/food-drink/article/13040299/first-sip-bootleggers-inn-opens-on-lower-broad (3 pages).

*Primary Examiner* — Patrick M. Buechner
*Assistant Examiner* — Michael J. Melaragno
(74) *Attorney, Agent, or Firm* — Daniel F. Nesbitt; Hasse & Nesbitt LLC

(57) ABSTRACT

A pour spout device including a lid and a vented pour spout for improving the sealing of an opening of a wide-mouthed jar or container. The lid has a cover and a threaded outer wall, and a seal ring track on the inner side of the cover, having an inner boundary defined by a plurality of retaining ribs spaced radially inwardly from the outer wall of the lid. An annular seal is removably secured within the seal ring track and is retained by the plurality of retaining ribs. Each quadrant of the inner side of the lid has at least one of the arcuate-shaped retaining ribs, each having an outer-facing surface that retains the inside edge of all four quadrants of the annular seal from being biased laterally out of the seal ring track when the annular seal is squeezed between the lid and the upper rim of the container.

6 Claims, 8 Drawing Sheets

(51) Int. Cl.
*A47G 19/22* (2006.01)
*B65D 43/02* (2006.01)

(58) Field of Classification Search
USPC ..... 215/234, 341, 349, 350, 351, 352; 220/304; 222/341, 349, 350, 351, 479, 222/548, 551
See application file for complete search history.

(56) References Cited

U.S. PATENT DOCUMENTS 1,613,358 A * 1/1927 Payne ..... B65D 51/04 215/245
2,047,977 A * 7/1936 McGowan ..... B65D 53/02 156/69
2,187,395 A * 1/1940 Glocker ..... B67B 7/20 215/262
2,271,943 A * 2/1942 Klein ..... B65D 85/02 220/301
2,628,735 A * 2/1953 McGowan ..... B65D 51/145 215/232
2,827,192 A * 3/1958 Warth ..... B65D 53/02 215/352
3,122,116 A * 2/1964 Hagmann ..... B21D 51/44 215/352
3,233,797 A 2/1966 Conry
3,321,113 A 5/1967 Conry
3,435,976 A * 4/1969 Owens ..... B65D 41/0414 215/329
4,308,965 A * 1/1982 Dutt ..... B65D 41/0442 215/345
4,346,812 A * 8/1982 Banich, Sr. ..... B65D 41/04 215/352
4,366,913 A * 1/1983 Winchell ..... B65D 41/62 215/329
4,398,652 A 8/1983 Ueda et al.
4,461,393 A * 7/1984 Dutt ..... B65D 41/0442 215/329
4,648,520 A * 3/1987 Stull ..... B65D 41/045 215/350
4,697,716 A * 10/1987 Mumford ..... B65D 41/0442 215/341
4,753,360 A * 6/1988 Baxter ..... B65D 41/3447 215/252
5,037,015 A 8/1991 Collins
5,337,918 A * 8/1994 Wang ..... A47G 19/2266 215/229
5,785,196 A * 7/1998 Montgomery ..... B65D 41/0414 215/270
5,938,095 A * 8/1999 Haar ..... A45C 3/10 224/235
6,102,227 A * 8/2000 Cochrane ..... B65D 41/3442 215/256
RE37,016 E 1/2001 Morano
6,425,492 B1 * 7/2002 Ekkert ..... B65D 41/045 215/350
7,163,115 B2 * 1/2007 Whitley ..... B01L 3/50825 215/276
7,419,066 B1 * 9/2008 Ewers ..... B65D 51/1688 215/309
7,766,182 B2 * 8/2010 Trent ..... B65D 41/0442 215/307
8,887,968 B1 11/2014 Call
2005/0139611 A1 * 6/2005 Kubo ..... B65D 47/06 222/189.06
2008/0017675 A1 1/2008 Pressey
2012/0181307 A1 7/2012 Grosser
2015/0274384 A1 * 10/2015 Goldstein ..... B65D 47/06 222/1

* cited by examiner

POUR SPOUT DEVICE

CROSS-REFERENCE TO RELATED APPLICATIONS

This application claims the benefit of U.S. Provisional Application No. 62/594,204 filed Dec. 4, 2017, the disclosure of which is incorporated herein by reference in its entirety.

TECHNICAL FIELD

The technology described herein generally relates to pour spouts, and more particularly relates to a cap for a wide-mouthed container, which has been adapted for pouring the contents of the container with the cap in place.

BACKGROUND

Liquids and other dispensable materials, such as powders, gels, and granules, have been stored in a variety of containers having lids, caps, or stoppers adapted to permit pouring or decanting of the materials.

A number of different pour spouts have been developed to both address the types of liquid or powders, etc., that might need to be poured from a container, as well as fit the range of containers that have been used to store the liquids.

Alcoholic beverages such as whiskey have normally been stored and shipped in, and served from, bottles with narrow necks. To convert such bottles from a shipping and storing role to a serving role, they have typically been fitted with specially adapted pour spouts that seal the top of the bottle and provide a metered flow of liquor when dispensing a shot. A bottle fitted with such a pour spout can conveniently be kept behind a bar, such as in an inn or restaurant, and used to dispense a drink to a customer on demand.

Other types of container, however, would not be suitable for this purpose. For example, a wide-mouthed jar may conveniently store liquor but would be a difficult receptacle from which to pour or dispense liquor. Recently, however, it has become popular to deliver traditional forms of liquor to bars and restaurants in wide-mouthed jars, such as Mason jars, and thereby emphasize aspects of the liquor's heritage. US Patent Publication 2012-01813071 A1 (Grosser) and US Application Publication 2015-0274384 (Goldstein and Webber), the disclosures of which are incorporated by reference in their entireties, describe a pour spout for a wide-mouthed container adapted to a screw-on lid to pour a liquid from the inside of the container to the outside. Grosser describes a single piece lid made of a lightweight metal such as Aluminum, Tin, or an alloy and attaches with threads to the threads of a wide-mouthed jar such as a Mason Jar. Goldstein and Webber describe a unitary cover lid with an integral pour spout.

Notwithstanding, there is a continuing need for an improved pour spout and lid for a wide-mouthed jar that has improved features for the cleaning of the pour spout and lid, and with improved sealing properties.

SUMMARY OF THE INVENTION

The present invention provides a pour spout device comprising: (a) a lid comprising a cover and an outer wall comprising one or more thread elements for attaching the lid to a threaded wide-mouthed container, the cover having an outer side and an inner side, and the lid including a seal ring track on a periphery of the inner side of the cover, having an outer boundary defined by the outer wall, and an inner boundary defined by a plurality of retaining ribs positioned on and extending radially from the cover, and spaced radially inwardly from the outer wall; and (b) a vented spout comprising an inner end that extends from the inner side of the cover lid and includes a draw tube, an outer end that extends from the outer side of the cover lid that includes a spout outlet, the vented spout having a main passageway extending from spout outlet of the outer end to draw tube of the inner end, and having at least one aperture disposed in the inner end along and in fluid communication with the main passageway.

The pour spout device also preferably includes an annular seal ring removably secured within the seal ring track, retained by the plurality of retaining ribs. The seal ring can comprise an elastomeric seal ring.

In an embodiment of the invention, the inner side of the cover being dividable into quadrants, each quadrant having disposed therein at least one of the plurality of retaining ribs.

In an embodiment of the invention, the cover is circular, and the inner boundary is a circle.

In an embodiment of the invention, each of the plurality of retaining ribs is formed into an arcuate-shaped rib that extends along an arc portion of the circular inner boundary.

In an embodiment of the invention, the inner boundary is defined in part by an outer surface of the plurality of retaining ribs.

These and other features and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Figure 1:
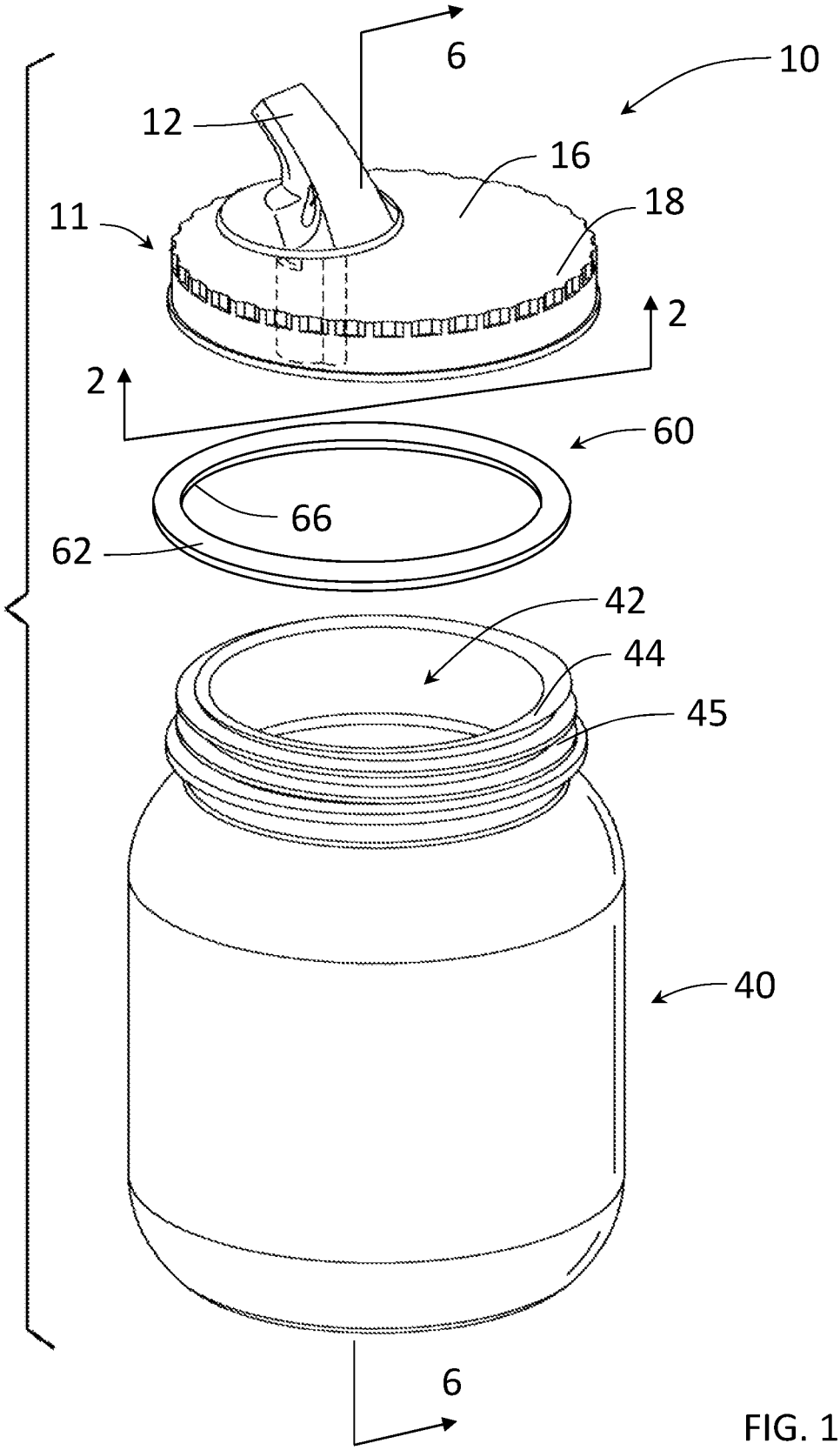
FIG. 1 is a top, exploded perspective view of a pour spout device, a seal ring and a wide-mouthed container.

FIG. 1 shows an exploded, elevation view of a pour spout device 10 of the present invention, along with a seal ring 60 and a wide-mouthed container 40. The seal ring 60 can be associated with the pour spout device 10 to provide a leakage seal along the upper rim 44 of the wide mouth opening 42 of the container 40 when the pour spout device 10 is attached to the container 40 by threading the outer wall 18 of the pour spout device 10 onto the outer threads 46 of the neck 45 of the wide-mouthed container 40.

Figure 2:
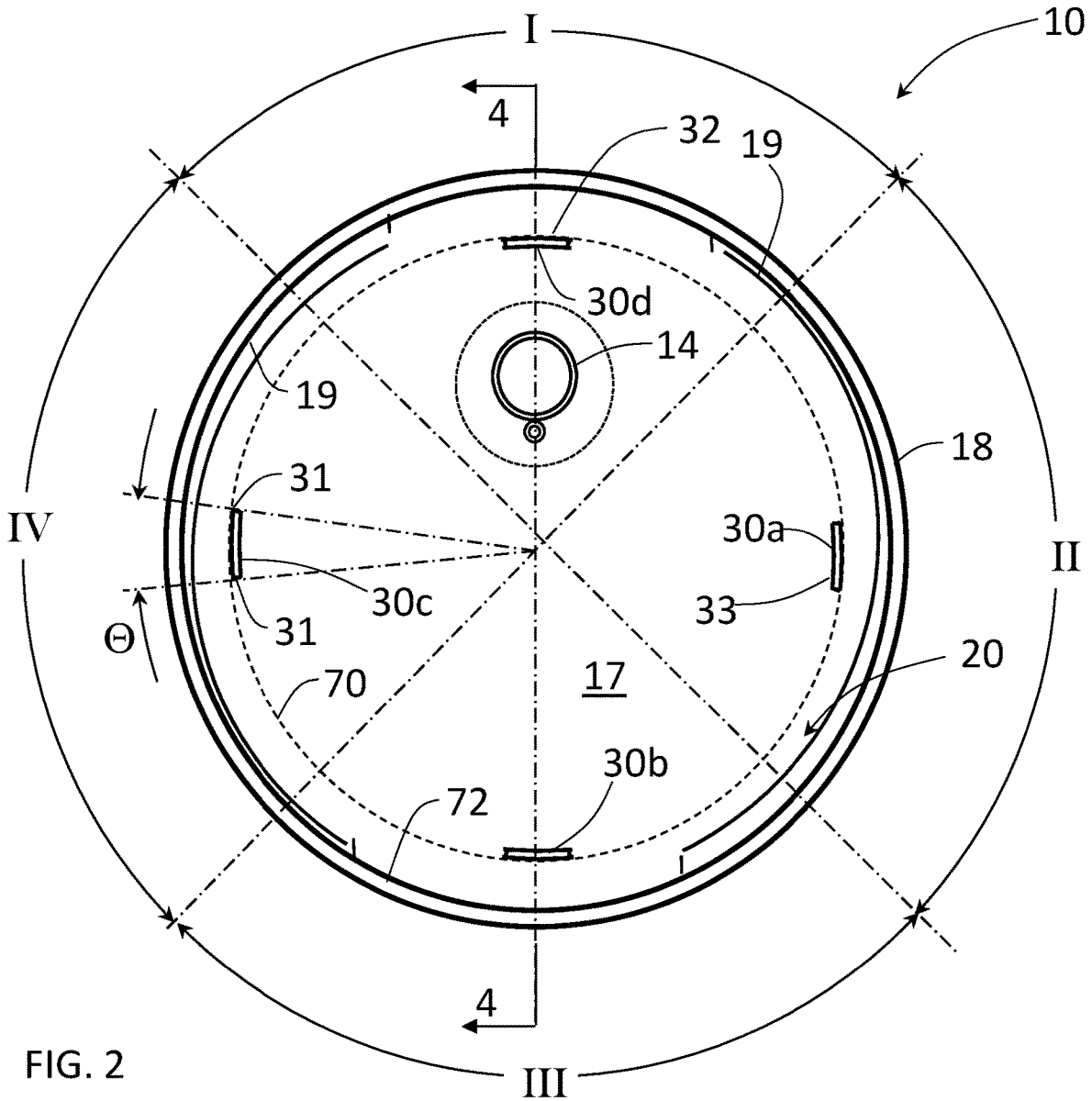
FIG. 2 is a plan view of an inner side of the pour spout device, viewed from line 2-2 of FIG. 1, illustrating the seal ring and a plurality of retaining ribs spaced radially inwardly from the outer wall of the cover, in accordance with the present invention.
Figure 4:
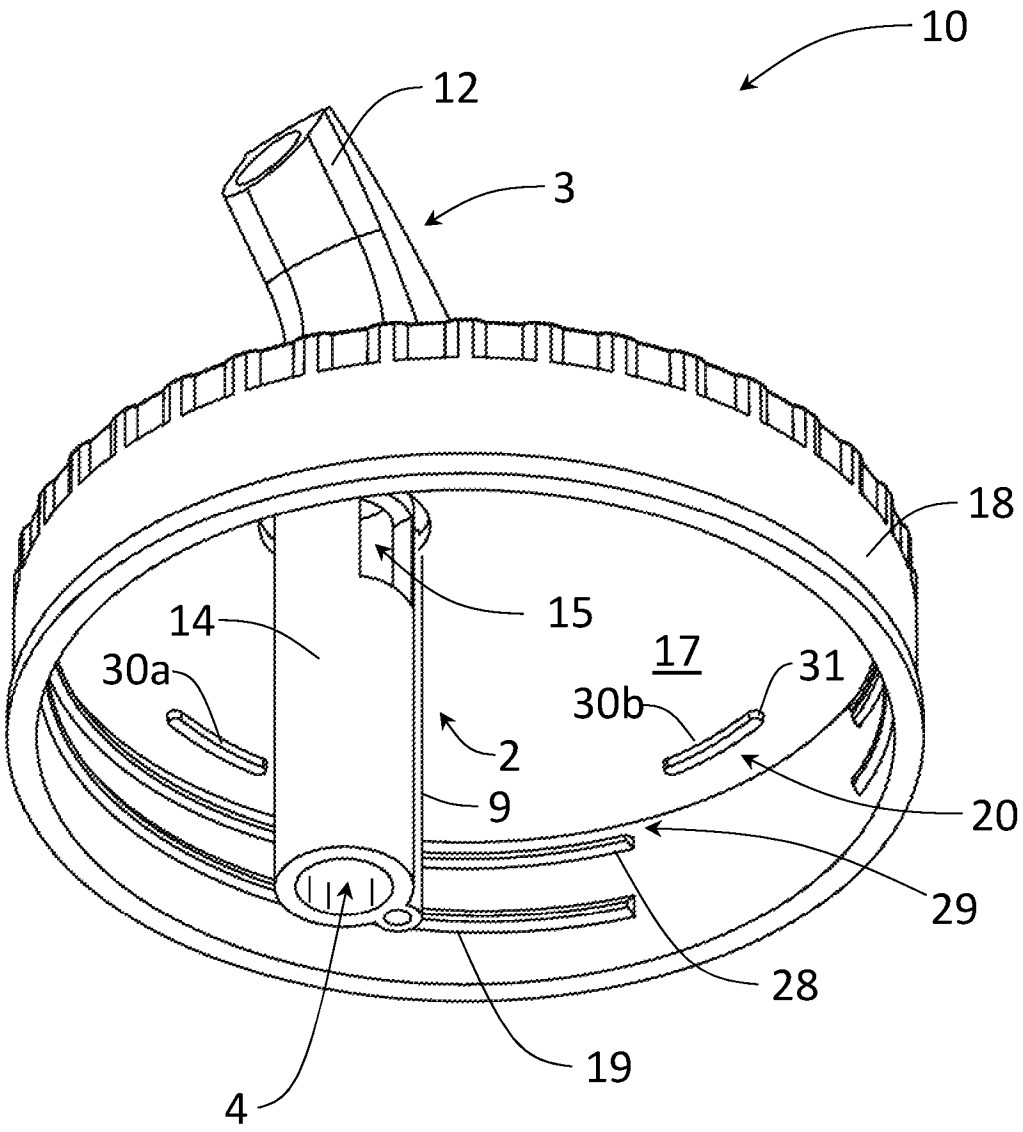
FIG. 4 is a bottom perspective view of the pour spout device.
Figure 5:
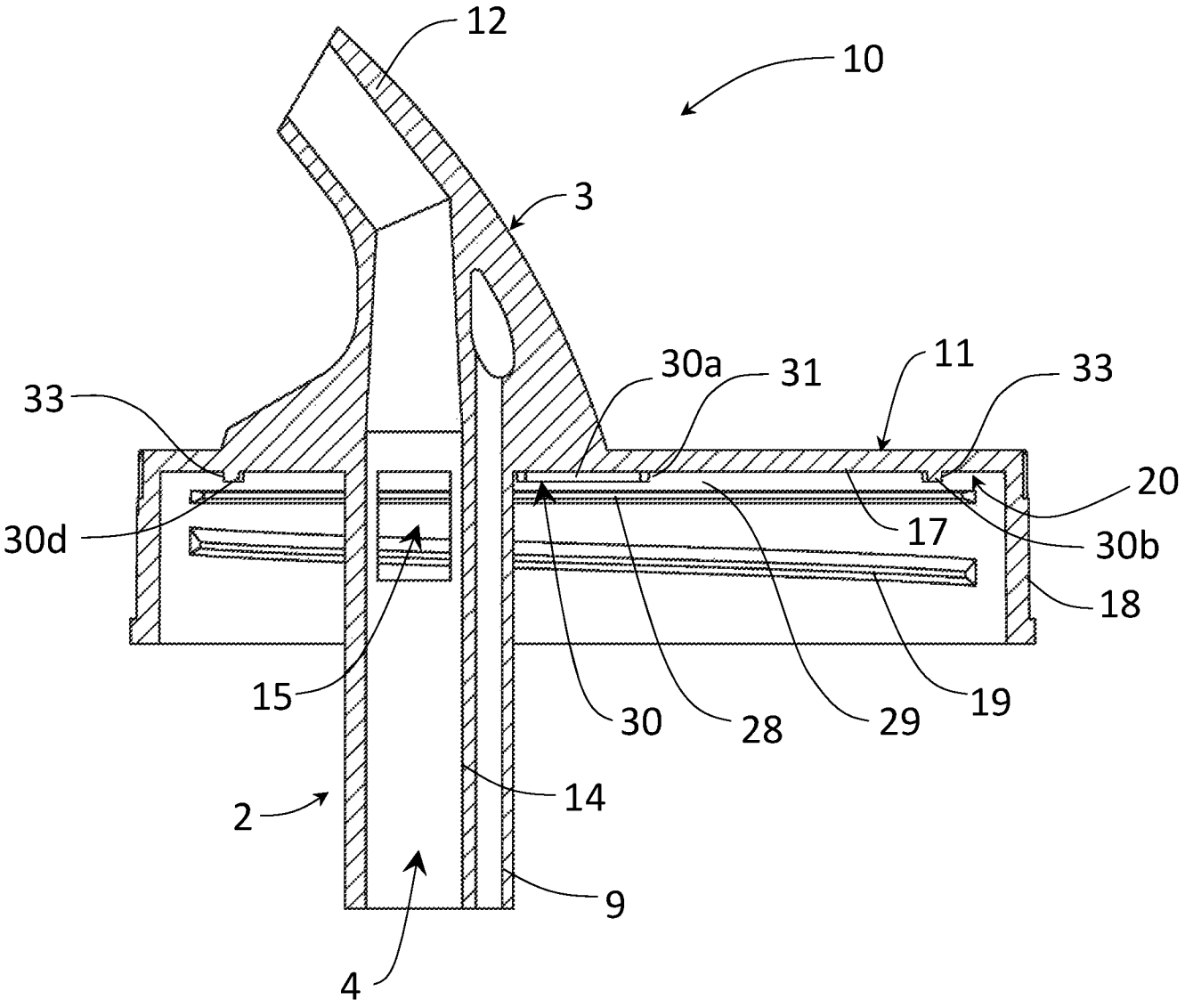
FIG. 5 is a cross-sectional view of the pour spout device, taken through line 5-5 of FIG. 2.

FIGS. 2, 4 and 5 illustrate the features of the pour spout device 10. FIG. 2 is a plan view of an inner side of the pour spout device 10. FIG. 4 is a bottom perspective view of the pour spout device 10. FIG. 5 is a sectional view through the pour spout device 10, taken through line 5-5 of FIG. 2. The pour spout device includes a lid 11 that comprises a cover 16 that can extend across an opening 42 in the container 40, and an annular outer wall 18 that extends from a peripheral edge of the cover 16 to form a closure. The outer wall 18 of the lid 11 also comprises an attaching component, shown as a thread segment 19, that matingly engages a thread 46 on the outside of the neck 45 of the container 40, for attaching the lid 11 to, and enclosing, the wide-mouthed container 40. The cover 16 has an outer side exposed to the outside of the enclosed container 1 (FIG. 7A), and an inner side 17 exposed to the inside volume of the container 40.

The lid 11 also includes a seal ring track 20 on the inner side 17 of the cover 16, into and against which a seal ring 60 is placed and retained. The seal ring track 20 has an outer boundary 72 defined by the inner surface of the wall 18, and an inner boundary 70 spaced radially inwardly from the outer wall 18. The seal ring track 20 includes a means for retaining the seal ring 60 in a position in registry with the upper rim 44 of the container 40 when the lid 11 is threaded onto the container 40. The means for retaining the seal ring 60 in the seal ring track 20 includes a plurality of ribs or ridges extending from either or both the inner side 17 of the cover 16 and the inner surface of the wall 18.

One or more first rib or ridge comprises one or more ridge 28 extending peripherally along at least a portion of the inner surface of the outer wall 18, at a fixed axial distance from the inner side 17 of the cover 16. The one or more ridges 28 can include two or more ridges 28 spaced apart circumferentially. The one or more ridges 28 define a groove 29 between the ridge 28, the inner surface of the outer wall 18, and the inner surface of the cover 16, into which an outer edge 62 (see FIG. 1) of the seal ring 60 is captured when the seal ring 60 is disposed within the seal ring track 20.

In addition, a plurality of retaining ribs 30 define at least a portion of the inner boundary 70. In an embodiment of the invention, the cover 16 is circular, and the inner boundary 70 is a circle. The plurality of retaining ribs 30 extend axially from the inner surface 17 of the cover 16, and are spaced radially inwardly from the inner surface of the outer wall 18, to define a portion of the inner boundary 70 of the seal ring track 20. As shown in FIG. 5, a cross-sectional shape of the retaining ribs 30 can be rectangular or square, but can also be shaped like a pyramid or a dome. The inner boundary 70 is defined at least in part by the outer-facing surfaces 33 of the retaining ribs 30 that face radially outwardly and extend between opposite ends 31 of the arcuate retaining ribs 30.

In an embodiment of the invention, the seal ring can consist of a flat, annular ring 60 of an elastomeric material, and the plurality of retaining ribs 30 have a height, from the inner side 17 of the cover 16 of less than a thickness of the flat annular ring 60. The flat, annular ring 60 can be disposed within the seal ring track 20, and the plurality of retaining ribs 30 have a height from the inner side 17 of the cover 16 that extends less than a thickness of the flat, annular ring 60.

As shown in FIG. 2, the inner side 17 and outer wall 18 of the lid 11 can consist of four quadrants, namely quadrant I in an upper quarter in FIG. 2, quadrant II in a right quarter, quadrant III in a lower quarter, and quadrant IV in a left quarter. At least one of the plurality of retaining ribs 30 is disposed within each quadrant, and each of the quadrants includes at least one of the plurality of retaining ribs 30. In another embodiment, at least one of the plurality of retaining ribs 30 is disposed within about 75-105 degrees, including about 90 degrees, from another one of the plurality of retaining ribs 30. In the illustrated embodiment, a first retaining rib 30*a* is disposed at about 12 o'clock along the inner boundary 70; a second retaining rib 30*b* is disposed at about 3 o'clock along the inner boundary 70; a third retaining rib 30*c* is disposed at about 6 o'clock along the inner boundary 70; and a fourth retaining rib 30*d* is disposed at about 9 o'clock along the inner boundary 70.

In an embodiment of the invention, the plurality of retaining ribs 30 in total extend less than 50% of the circumference of the inner boundary 70, and more particularly less than 75% of the circumference of the inner boundary 70, and even more particularly less than 90% of the circumference of the inner boundary 70.

In an embodiment of the invention, each of the plurality of retaining ribs 30 is formed into an arcuate shaped that extends along an arc portion of the circular inner boundary 70. As illustrated in FIG. 2, each retaining rib 30 extends between its respective ends 31 an arc angle θ. The arc angle θ can be an angle of at least 3 degrees, and up to about 70 degrees. Examples of a range of arc angle θ include at least 5 degrees, at least 7 degrees, at least 10 degrees, at least 15 degrees, at least 20 degrees, and at least 25 degrees, and up to about 60 degrees, up to about 50 degrees, up to about 40 degrees, up to about 30 degrees, up to about 20 degrees, and up to about 10 degrees. Each quadrant can include one, two, three, or more, retaining ribs 30, and any one retaining rib 30 can extend between any two fixed quadrants.

Figure 3:
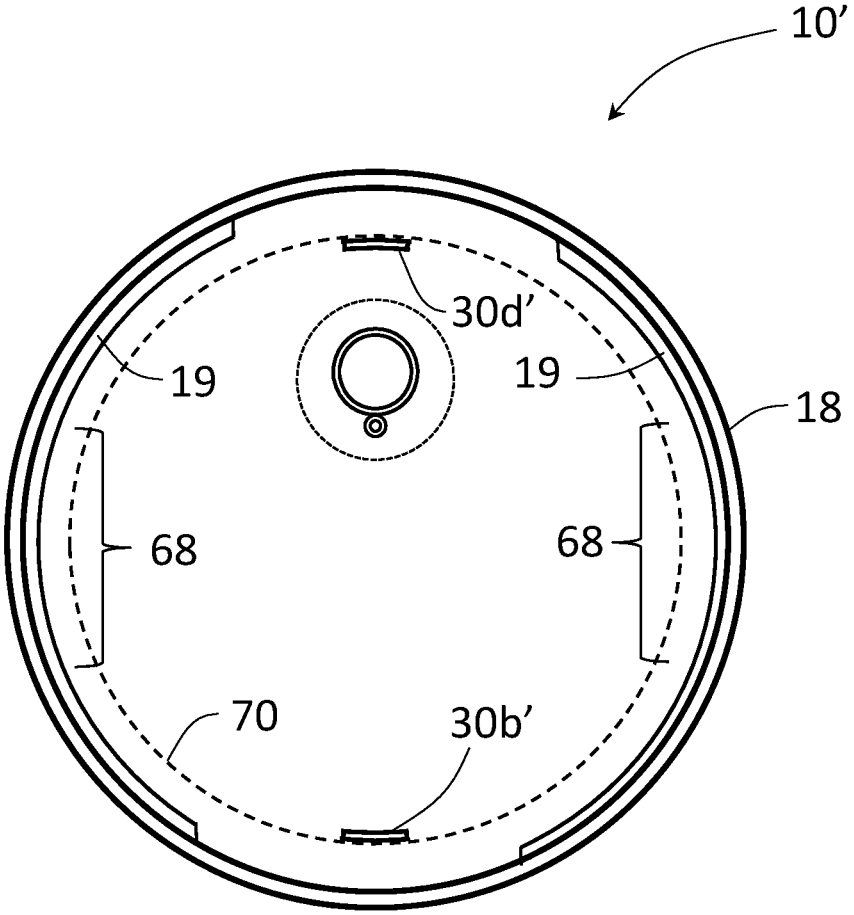
FIG. 3 Prior Art
FIG. 3 is a plan view of an inner side of a conventional pour spout device, illustrating the seal ring and a limited number, namely two, retaining ribs on opposite sides of the seal ring.

By comparison, as shown in FIG. 3, a conventional pour spout device 10' includes only a first retaining rib 30*a*' positioned at about 12 o'clock and a second retaining rib 30*b*' positioned at about 6 o'clock, each retaining rib 30*a*' and 30*b*' extending an arc angle of about 10 degrees. No retaining ribs are disposed in the 3 o'clock and 9 o'clock areas 68. While retaining the seal ring 60 at the 12 o'clock and 6 o'clock positions, the unretained segment of the seal ring 60, of about 170 arc degrees, permits the unretained segment of the seal ring 60 to be pressed and squeezed laterally and radially inwardly, and out of, the seal ring track 20, as the inner surface 17 of the cover 16 of the lid 11 is threaded down against the rim 44 of the neck 45 of the container 40, which compromises the sealing of the container.

Figure 6:
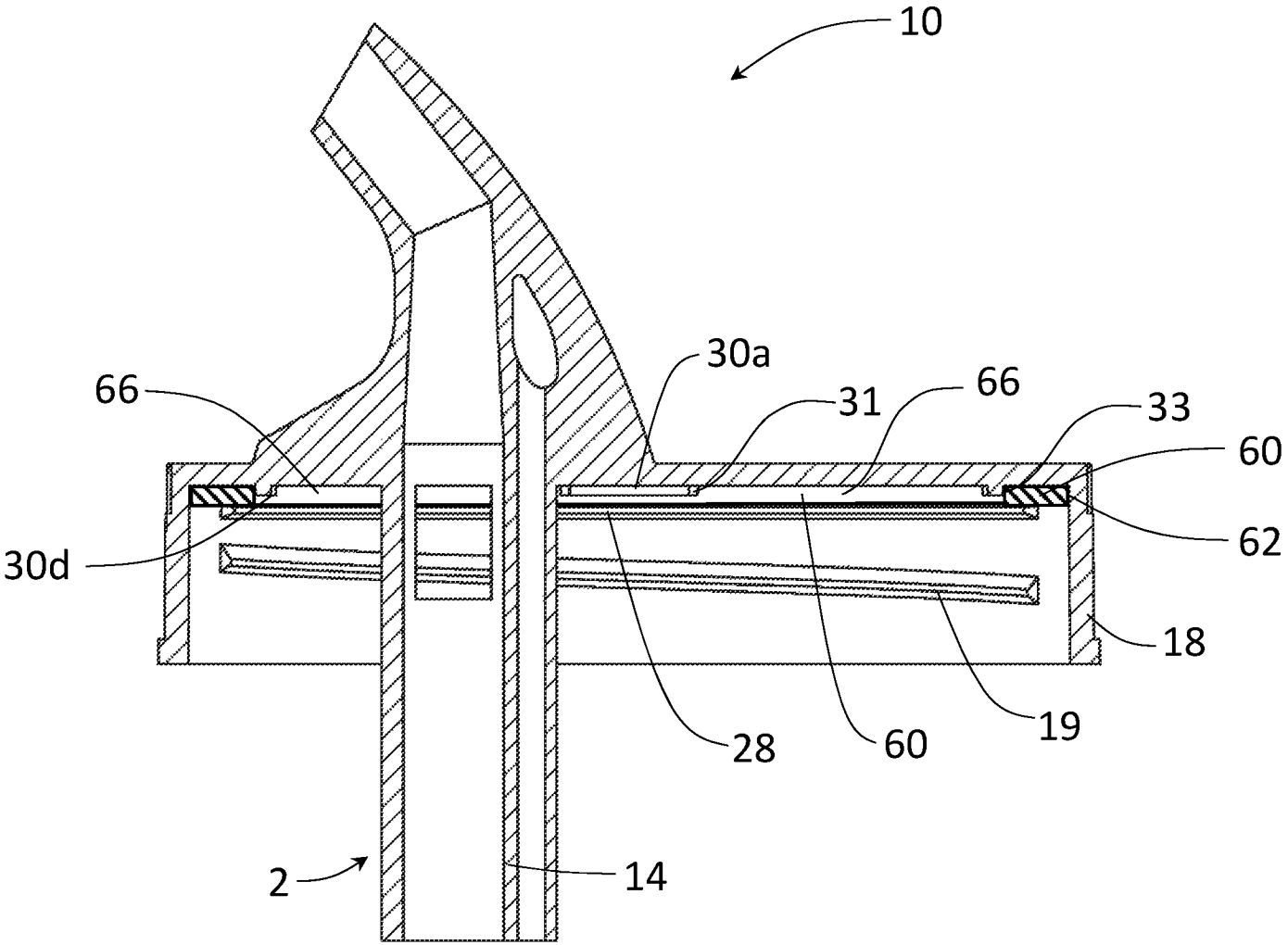
FIG. 6 is a cross-sectional view of the pour spout device of FIG. 5 with the seal ring positioned on the inner side of the cover.

FIG. 6 shows the seal ring 60 disposed within the seal ring track 20, with an inner edge 66 of the seal ring 60 (see FIG. 1, and shown disposed along the inner boundary line 70 as shown in FIG. 2) confronting the outer-facing surfaces 33 of the retaining ribs 30, including retaining rib 30*b* and retaining rib 30*d*, to capture laterally the quadrant segments of the seal ring 60 within the seal ring track 20. The positioning of the retaining ribs 30 around and along the perimeter of the inner boundary 70 provide a barrier or retainer to prevent the quadrant segments of the seal ring 60 from being biased out of the seal ring track 20, laterally toward the center of the lid 11, when the segments of the seal ring 60 are squeezed between the cover 16 and the rim 44 of the neck 45 of the container 40. This maintains the quality of the sealing of the container 40.

Figure 8:
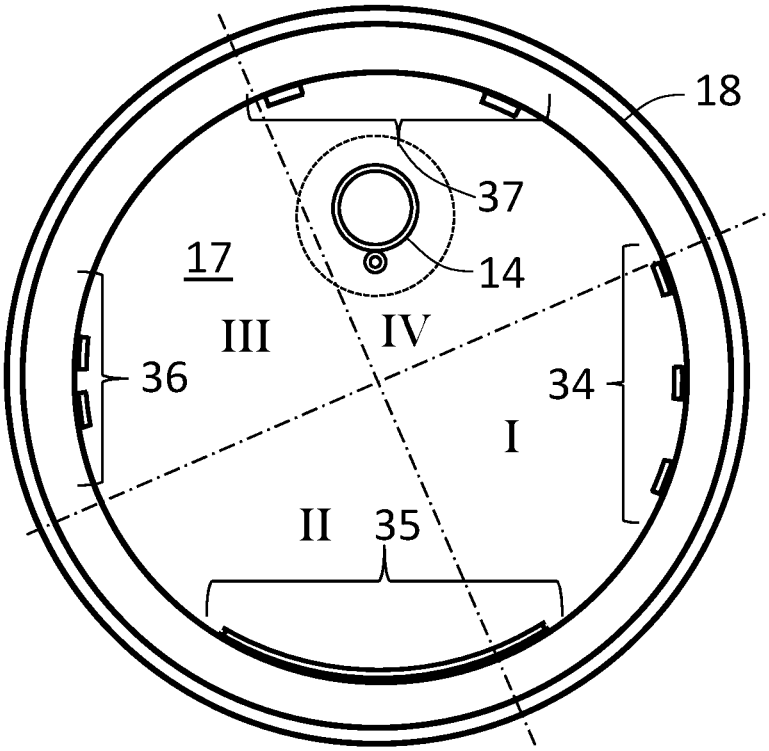
FIG. 8 is a plan view of an inner side of alternative embodiments of the pour spout device.

In FIG. 8, alternative embodiments of the retaining ribs 30 can be used in accordance with the invention. In one example, the retaining ribs in quadrant I consist of three retaining ribs 34 each of about 5 arc degrees and spaced apart by about 5 arc degrees. In another example, the retaining rib in quadrant II consists of a single retaining ribs 35 of about 70 arc degrees. In another example, the retaining ribs in quadrant III consist of a pair of retaining ribs 36 each of about 10 arc degrees and spaced apart by less than about 5 arc degrees. In another example, the retaining ribs in quadrant IV consist of a pair of retaining ribs 37 each of about 15 arc degrees and spaced apart by less than about 35 arc degrees.

The arc spaces between circumferentially-adjacent retaining ribs 30 are also believed needed to allow the seal ring 60 to be removed easily with a finger or finger nail of a user for cleaning. If a continuous and completely annular retaining rib were to be used, the removal of the seal ring 60 could be very difficult, and might require the use of a wedge or lever for removing the seal ring 60 from the seal ring track 20.

The annular seal can comprise a seal ring, and preferably an elastomeric seal ring. A non-limiting example of a material for making or forming an elastomeric seal ring can include silicone, natural or synthetic rubber, and others. Typically the elastomeric seal ring is a flattened ring having a ring width sufficient register with the upper rim 44 of the neck 45 of the container 40.

The wide-mouthed container 40 can include a wide-mouthed jar, such as a Mason jar.

Figure 7B:
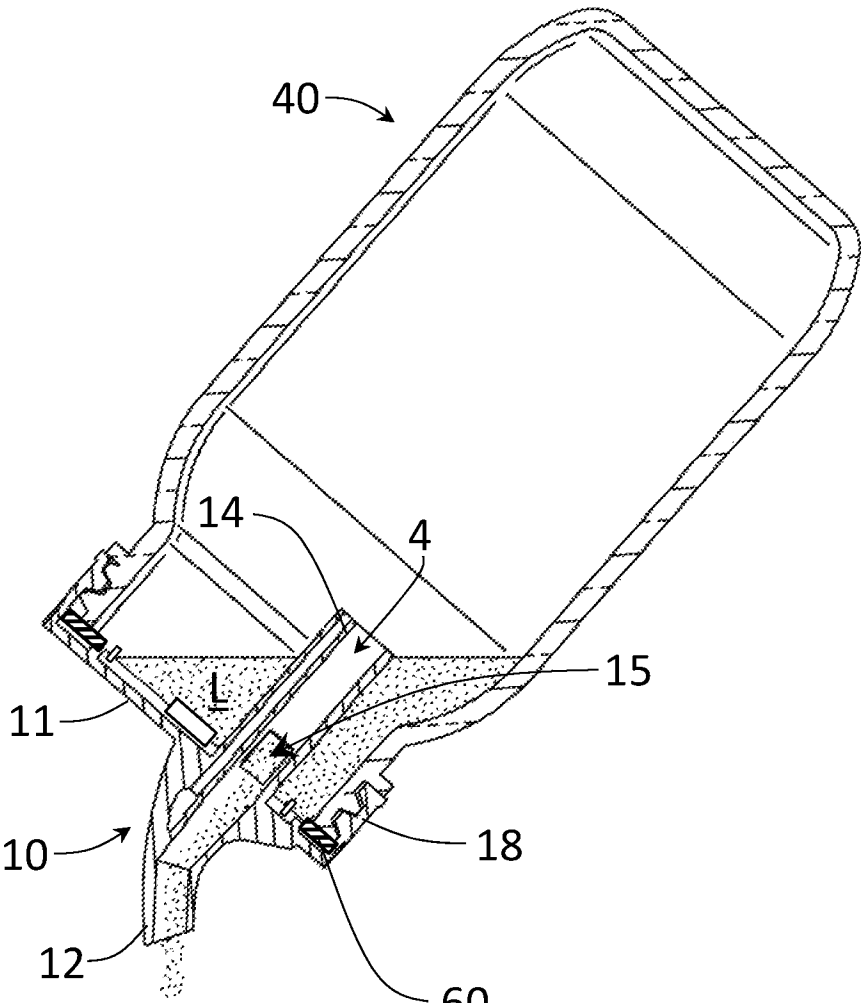
FIG. 7B is the assembled container of FIG. 6A, in a dispensing position.
Figure 7A:
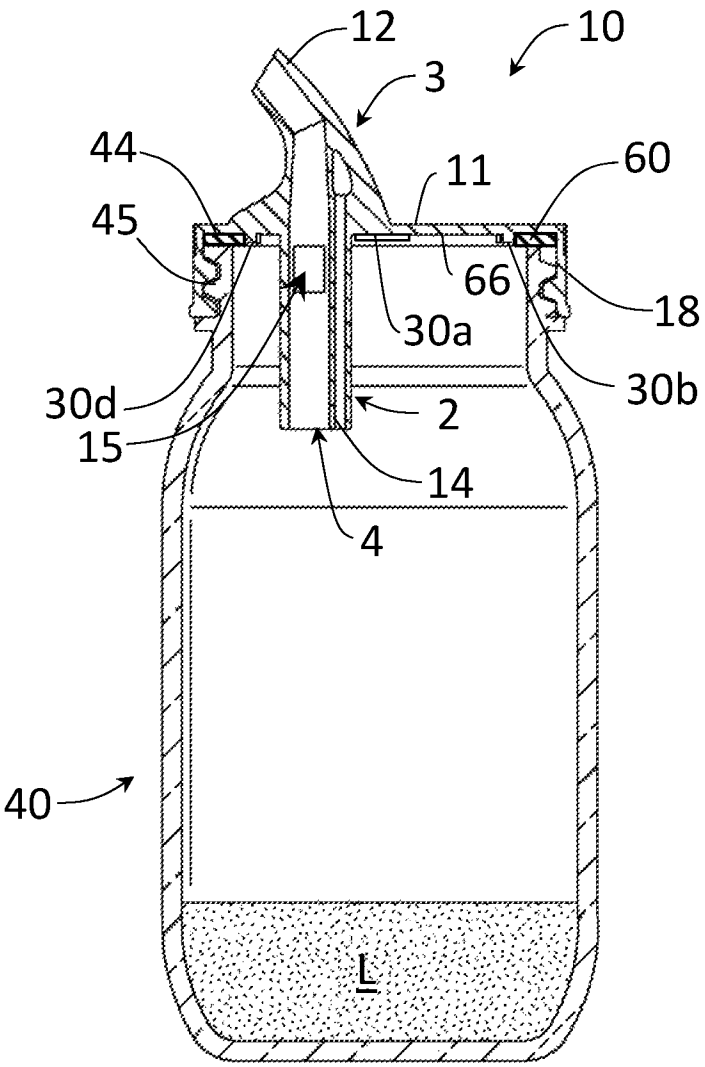
FIG. 7A is a cross-sectional view of an assembled container, consisting of the pour spout device, seal ring and wide-mouthed container of FIG. 1, taken through line 7-7, and containing a liquid beverage.

The pour spout device 10 also includes a vented spout comprising an inner end 2 that extends from the inner side 17 of the cover 16, and an outer end 3 that extends from the outer side of the cover 16 and that includes a spout outlet 12. The vented spout has a main passageway 4 extending from and in fluid communication between the spout outlet 12 of the outer end 3, and the draw tube 14 of the inner end 4, and has at least one aperture 15 disposed in the inner end 2 along and in fluid communication with the main passageway 4. FIG. 7A shows a liquid-filled, enclosed and sealed container 1, including the container 40 with liquid L, and the pour spout device 10 enclosing and sealing the container 40 with the seal ring 60. As shown in FIG. 7B, when the liquid-filled, enclosed and sealed container 1 is inverted, the liquid L inside the container 40 can pour out of the interior volume of the container 40 through the draw tube 14, and through the at least one aperture 15 as the volume and level of the liquid L is near emptied.

It should be understood, of course, that the foregoing relates to exemplary embodiments of the invention and that modifications may be made without departing from the spirit and scope of the invention as set forth in the following claims.

What is claimed is:

1. A pour spout device comprising:

(a) a lid comprising a cover and an outer wall comprising one or more thread elements for attaching the lid to a threaded wide-mouthed container, the cover being circular and having an outer side and an inner side, and the lid including a seal ring track on a periphery of the inner side of the cover, having an outer boundary defined by the outer wall, and a circular inner boundary defined by a plurality of retaining ribs positioned on and extending radially from the cover, and spaced radially inwardly from the outer wall, wherein each of the plurality of retaining ribs is formed into an arcuate-shaped rib that extends along an arc portion of the circular inner boundary, and a cross section of the plurality of retaining ribs is rectangular;

(b) an annular seal ring consisting of a flat annular ring of an elastomeric material removably secured within the seal ring track, retained by the plurality of retaining ribs in a position in registry with an upper rim of the threaded wide-mouthed container when the lid is threaded onto the container, wherein an inner edge of the annular seal ring confronts the plurality of retaining ribs, and wherein the plurality of retaining ribs have a height from the inner side of the cover of less than a thickness of the flat annular ring; and (c) a vented spout comprising an inner end that extends from the inner side of the cover lid and includes a draw tube, an outer end that extends from the outer side of the cover lid that includes a spout outlet, the vented spout having a main passageway extending from spout outlet of the outer end to draw tube of the inner end, and having at least one aperture disposed in the inner end along and in fluid communication with the main passageway.

2. The pour spout device according to claim 1 wherein the inner side of the cover is divided into quadrants, and each quadrant has disposed therein at least one of the plurality of retaining ribs.

3. The pour spout device according to claim 1 wherein the inner boundary is defined in part by an outer surface of the plurality of retaining ribs.

4. The pour spout device according to claim 1, wherein the plurality of retaining ribs in total extend less than 50% of the circumference of the inner boundary.

5. The pour spout device according to claim 4, wherein the plurality of retaining ribs in total extend less than 75% of the circumference of the inner boundary.

6. The pour spout device according to claim 5, wherein the plurality of retaining ribs in total extend less than 90% of the circumference of the inner boundary.

* * * * *